US009347654B2

(12) United States Patent
LeClair et al.

(10) Patent No.: US 9,347,654 B2
(45) Date of Patent: May 24, 2016

(54) LIGHTING DEVICE HAVING A MOVABLE HOUSING

(71) Applicant: LIGHTING SCIENCE GROUP CORPORATION, Satellite Beach, FL (US)

(72) Inventors: Rick LeClair, Indian Harbour Beach, FL (US); Mark Penley Boomgaarden, Satellite Beach, FL (US); Ryan Kelley, Denver, CO (US); Eric Holland, Indian Harbour Beach, FL (US)

(73) Assignee: Lighting Science Group Corporation, Melbourne, FL (US)

( * ) Notice: Subject to any disclaimer, the term of this patent is extended or adjusted under 35 U.S.C. 154(b) by 224 days.

(21) Appl. No.: 14/243,082

(22) Filed: Apr. 2, 2014

(65) Prior Publication Data

US 2015/0285473 A1 Oct. 8, 2015

(51) Int. Cl.

| | |
|---|---|
| ***F21V 19/00*** | (2006.01) |
| ***F21V 29/83*** | (2015.01) |
| ***F21K 99/00*** | (2016.01) |
| ***F21V 17/16*** | (2006.01) |
| *F21Y 101/02* | (2006.01) |

(52) U.S. Cl.

CPC ..... *F21V 19/0055* (2013.01); *F21K 9/135* (2013.01); *F21K 9/1355* (2013.01); *F21V 17/164* (2013.01); *F21V 29/83* (2015.01); *F21Y 2101/02* (2013.01)

(58) Field of Classification Search

CPC ... F21V 19/0055; F21V 29/83; F21V 17/164; F21K 9/135; F21K 9/1355

See application file for complete search history.

(56) References Cited

U.S. PATENT DOCUMENTS

| | | | | |
|---|---|---|---|---|
| 7,965,023 | B1 * | 6/2011 | Liang | F21K 9/1355 313/45 |
| 2013/0128596 | A1 | 5/2013 | Lu et al. | |
| 2013/0279175 | A1 * | 10/2013 | Hussell | F21K 9/10 362/310 |

FOREIGN PATENT DOCUMENTS

| | | |
|---|---|---|
| WO | WO 2013-060060 | 5/2013 |

* cited by examiner

*Primary Examiner* — Mary Ellen Bowman

(74) *Attorney, Agent, or Firm* — Mark Malek; Daniel Pierron; Widerman Malek, PL

(57) ABSTRACT

A lighting device may include an electrical base, a stabilizer adapted to be matingly connected to the electrical base, a body member, and an optic connected to the body member and defining an optical chamber. A light source may be positioned within the optical chamber and in electrical communication with the electrical base. The stabilizer may be transitionable from an engaged position with the electrical base and a disengaged position with the electrical base. The disengaged position allows for the stabilizer to be translated longitudinally with respect to the base member. The engaged position slidably fixes the stabilizer with respect to the heat sink by reducing space between the electrical base, the enclosure and the heat sink.

22 Claims, 5 Drawing Sheets

LIGHTING DEVICE HAVING A MOVABLE HOUSING

FIELD OF THE INVENTION

The present invention relates to the field of lighting devices and, more specifically, to a lighting device having a movable housing to provide for simplified assembly.

BACKGROUND OF THE INVENTION

A light emitting diode (LED) lamp (or LED light bulb) is a solid-state lamp that uses LEDs as the source of light. LEDs offer significant advantages over legacy light sources such as incandescent, high-intensity discharge (HID), and fluorescent lamps. These advantages include, but are not limited to, better lighting quality, longer operating life, and lower energy consumption.

LEDs typically utilize direct current (DC) electrical power and, in some cases, may be degraded or damaged by operating at high temperatures. Accordingly, LED lamps typically include heat dissipation elements, such as heat sinks and cooling fins to provide cooling capacity, thus maintaining an LED-based light bulb within a desirable operating temperature.

LED-based lamps are being increasingly used not only in original product designs, but also in products designed to replace legacy light sources in conventional lighting applications. LED lighting devices are normally manufactured with multiple elements. These elements are normally constructed to exacting specifications, but the elements can only be constructed within a certain degree of precision. Therefore, the design of an LED lighting device must be able to tolerate and utilize elements within particular specified dimensions. The design process may become more expensive and complex to allow for those tolerances and the manufactured LED lighting device may include space between internal elements to accommodate for such tolerances.

Such space, as slight as it may be, between the internal elements may reduce stability and structural integrity of the lighting device. This can be problematic, especially when shipping lighting devices, as a physical impact upon the lighting device may cause the internal elements to be damaged by contacting one another.

PCT Patent Application Publication No. WO 2013060060 to Wang (hereafter referred to as "Wang") discloses an LED bulb-shaped light. The LED bulb-shaped light includes a housing component, an LED circuit component and a lighting circuit component. U.S. Patent Application Publication No. 2013/0128596 by Lu et al. (hereafter referred to as "Lu") discloses an LED bulb. The LED bulb includes a connector, a heat sink, a drive circuit and an LED. The body of the bulb is designed with tunnels to improve heat dissipation of the heat sink. However, the LED bulbs of Wang and Lu respectively, each contain the same design flaw that afflicts other LED lights. There is space between the internal elements in the LED bulb.

Accordingly, a need exists for an LED lighting device that can be manufactured, which minimizes space between internal components to enhance the life of the LED lighting device. This background information is provided to reveal information believed by the applicant to be of possible relevance to the present invention. No admission is necessarily intended, nor should it be construed, that any of the preceding information constitutes prior art against the present invention.

SUMMARY OF THE INVENTION

With the foregoing in mind, the present invention is related to a lighting device having a stabilizer. The stabilizer of the lighting device, according to embodiments of the present invention, may be provided by a movable housing that may engage various internal elements so as to form a more structurally sound unit. The stabilizer of the lighting device according to embodiments of the present invention advantageously provides a more stable lighting device that reduces manufacturing costs. The lighting device having a stabilizer according to embodiments of the present invention further advantageously provides enhanced life of the lighting device as contact between internal components are greatly reduced.

These and other objects, features and advantages according to an embodiment of the present invention are provided by a lighting device that may include an electrical base, and a stabilizer adapted to be matingly connected to the electrical base. The lighting device may also include a body member. The body member may be positioned in thermal communication with the stabilizer. Furthermore, the body member may be a heat sink Additionally, the lighting device may include an optic, which may define an optical chamber and may be connected to the body member. The lighting device may further include a light source. The light source may be positioned in thermal communication with the body member. Furthermore, the light source may be positioned within the optical chamber and in electrical communication with the electrical base. The stabilizer may be transitionable between an engaged position with the electrical base and a disengaged position with the electrical base. The disengaged position may allow for the stabilizer to be translatable longitudinally with respect to the body member. The engaged position may prevent the stabilizer from translating longitudinally with respect to the body member. This may be accomplished by reducing space between the electrical base, the optic and the body member. Furthermore, a force may be exerted by the stabilizer on at least one of the optic and the light source so as to prevent relative motion therebetween.

In an embodiment of the lighting device according to the present invention, the electrical base may be an Edison base. The light source may be a plurality of lighting devices. The stabilizer may be substantially cylindrical. Additionally, the stabilizer may include a bottom portion that matingly engages the electrical base, an intermediate portion and a top portion.

The light source may include a circuit board and a plurality of light sources mounted to the circuit board. The circuit board may include an aperture formed along a medial portion thereof. The bottom portion of the stabilizer may be threaded. An interior portion of the electrical base may similarly be threaded so that the bottom portion of the stabilizer may threadably connect to the electrical base. The top portion of the stabilizer may include an engaging member that may be adapted to pass through the aperture of the circuit board. Rotation of the electrical base in a first direction may cause the stabilizer to be positioned in the engaged position so that the engaging member of the stabilizer engages the circuit board. Rotation of the electrical base in a second direction may cause the stabilizer to be positioned in the disengaged position so that the engaging member of the stabilizer disengages the circuit board. In some embodiments, the engaging member may engage a connecting member of the optic which, in turn, may engage a crush member. The crush member may be positioned between the connecting member and the circuit board.

The lighting device according to embodiments of the present invention may also include a spacer positioned between the electrical base and the heat sink adjacent to the intermediate portion of the stabilizer. The plurality of light sources may be a plurality of light emitting diodes (LEDs) that are circumferentially positioned on the circuit board. The lighting device may further include an optic which may be a two piece optic that includes a top section and a bottom section. Each of the top section and the bottom section of the optic may include a plurality of vents. Additionally, either of the top or bottom sections may include a ridge configured to interface and engage with the circuit board.

The details of one or more embodiments of the invention are set forth in the accompanying drawings and the description below. Other features, objects and advantages of the invention will be apparent from the description and drawings, and from the claims.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Additionally, in the following detailed description, reference may be made to the driving of light emitting diodes (LEDs). A person of skill in the art will appreciate that the use of LEDs within this disclosure is not intended to be limited to the any specific form of LED, and should be read to apply to light emitting semiconductors in general. Accordingly, skilled artisans should not view the following disclosure as limited to any particular light emitting semiconductor device, and should read the following disclosure broadly with respect to the same. Those skilled in the art will also appreciate that the terms luminaire and lighting device are interchangeably used throughout this disclosure and are meant to refer to the same structural items.

Figure 1A:
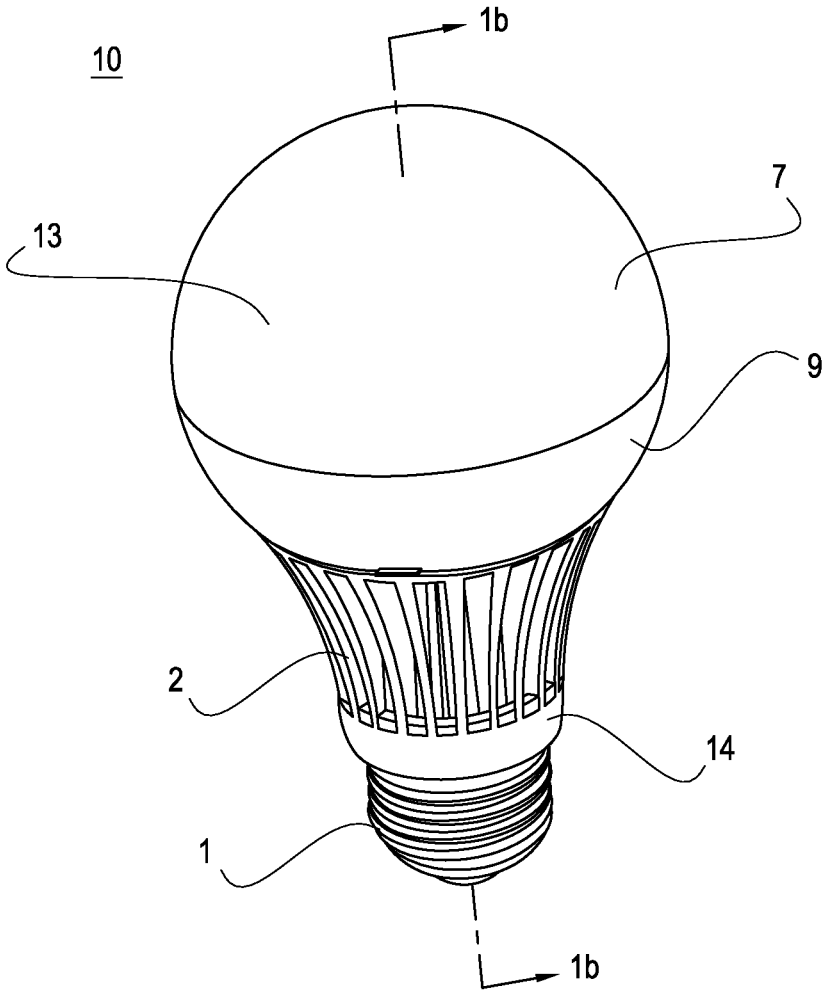
FIG. 1*a* is a perspective view of a lighting device according to an embodiment of the present invention.
Figure 1B:
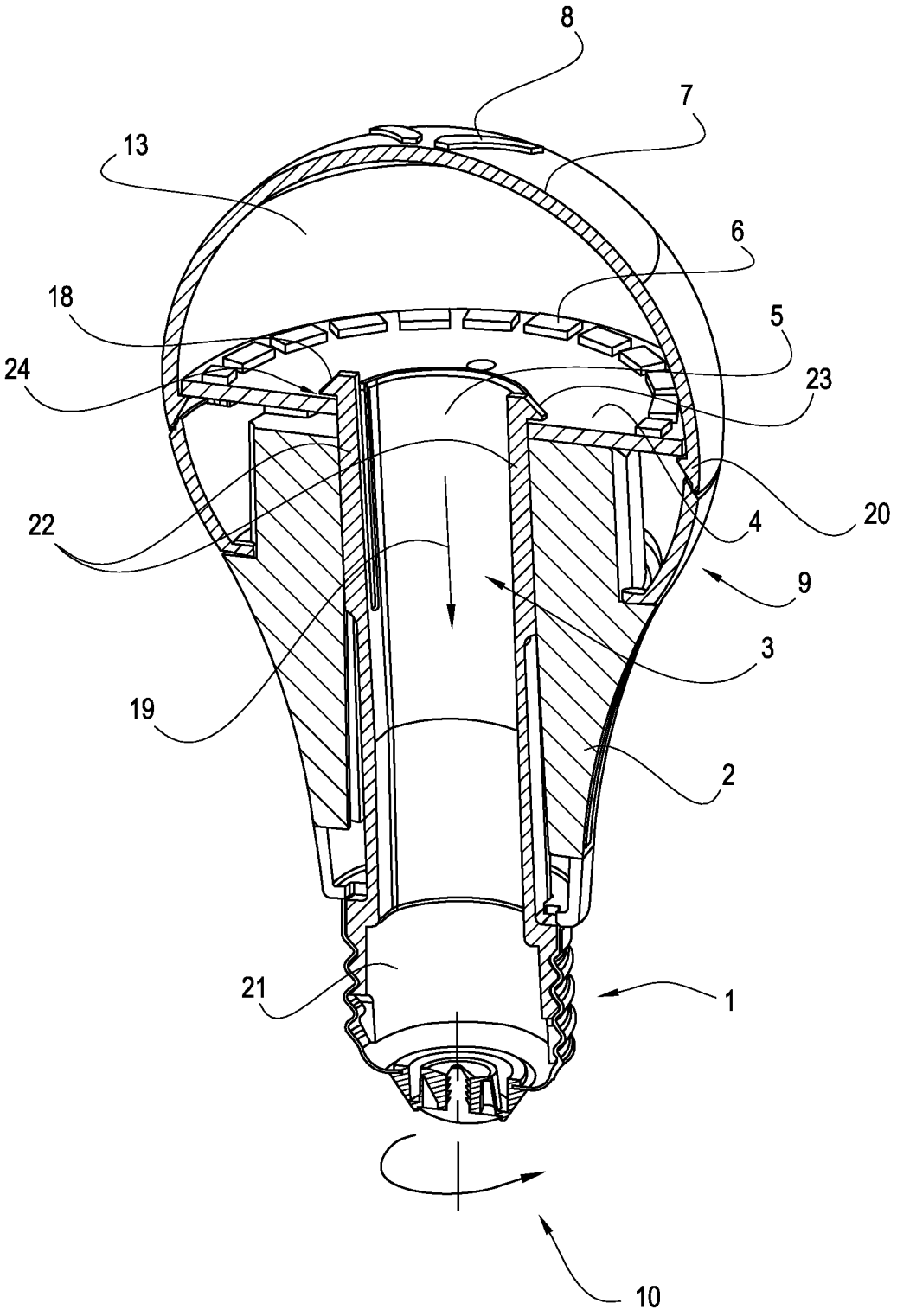
FIG. 1*b* is a perspective cross sectional view of the lighting device according to an embodiment of the present invention taken through line 1*b*-1*b* of FIG. 1*a*.
Figure 2:
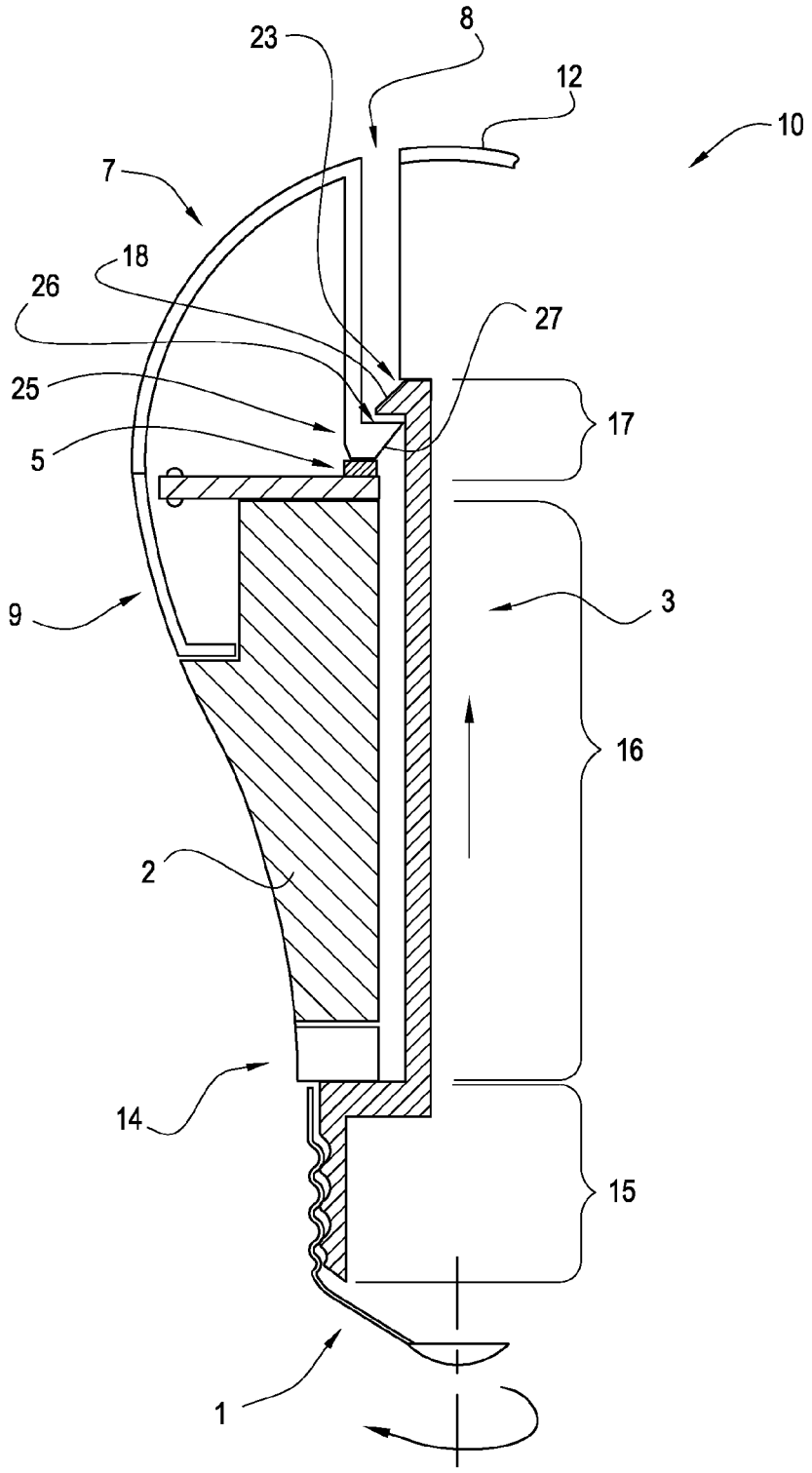
FIG. 2 is a partial side sectional view of a lighting device according to an embodiment of the invention.

Referring now to FIGS. 1*a*-2, a lighting device 10 according to embodiments of the present invention is now described in greater detail. The lighting device 10 may include an electrical base 1, a stabilizer 3, a body member 2, a light source 6 and an optic 13. The body member 2 may be positioned in thermal communication with the stabilizer 3 and connected to the optic 13. The stabilizer 3 may also be connected to the electrical base 1. The stabilizer 3 of the lighting device 10 may be moveable in a longitudinal direction.

The lighting device 10 according to an embodiment of the present invention may be shaped generally like an incandescent light bulb. For example, the optic 13 may be formed like the dome shaped optic seen in most A-series bulbs. Those skilled in the art will appreciate, however, that the lighting device 10 illustrated in the appended Figures is not limited to having the shape of a traditional incandescent light bulb. Instead, the lighting device 10 according to embodiments of the present invention may take on any form factor such as, for example, A19, BR series, PAR series, G series, or any series or other form factor that is readily understood by those skilled in the art. The lighting device 10 may similarly feature an Edison base.

The light source may include a plurality of light sources. Furthermore, the light source 6 may include an LED or a plurality of LEDs. In FIG. 1*b*, the lighting device 10 is illustrated with a light source 6 where the light source 6 is a plurality of LEDs arranged around the circumference of the circuit board 4. A person of ordinary skill in the art would realize that the light source 6 may not be an LED or a plurality of LEDs. The light source 6 may be modified without departing from the scope of the invention. A person of ordinary skill in the art would also appreciate that the light source 6 may be arranged any pattern of distribution of the plurality of LEDs on the circuit board 4 is contemplated and included within the scope of the invention. Additionally, the light source 6 may be thermally connected to the body member 2 thereby increasing the thermal dissipation capacity of the lighting device 10.

The lighting device 10 according to an embodiment of the present invention, however, provides advantages over current light devices. The preferred embodiment of the present invention utilizes LEDs which may have an operational life of 100,000 hours. LED lamps are efficient. Additionally, the lighting device of the current invention features a stabilizer 3 which can engage the elements of the lighting device 10 to reduce minuscule spaces among the elements in the lighting device 10, thereby reducing or eliminating movement of the elements of the lighting device 10 relative to one another. Therefore, the stabilizer 3 of the present invention advantageously enables the lighting device 10 to be a sturdier lighting device that is less likely to suffer from physical damage when compared to similar devices.

Continuing to refer to FIGS. 1-2, additional details of the electrical base 1 of the lighting device 10 according to embodiments of the present invention are now described in greater detail. More specifically, the electrical base 1 may be an Edison base. The electrical base 1 may be a threaded metal base which screws into a matching socket. The electrical base 1 may threadably engage a socket when the base is inserted into the socket and screwed into place. The light source 6 may be in electrical communication with the electrical base 1. Therefore, when the electrical base 1 engages the socket, power may be provided to the light source 6. As will be described in more detail hereinbelow, the electrical base 1 may be rotated in a first direction 100 to cause the stabilizer 3 to engage the elements of the lighting device 10, and the electrical base 1 may be rotated in a second direction to disengage the stabilizer 3 from the elements of the lighting device 10. More specifically, the rotation of the electrical base 1 may cause the stabilizer 3 to translate longitudinally along a longitudinal axis 19 of the stabilizer 3. Longitudinal translation by the stabilizer 3 may cause the stabilizer to exert a force on the circuit board 4, thereby pressing the circuit board 5 against the body member 2, affecting a clamping force on the circuit board 4 to prevent movement thereof relative to either of the stabilizer 3 or the body member 2, or both.

Although an Edison base is illustrated as the electrical base 1 of the lighting device 10, those skilled in the art will appreciate that any other type of electrical base is contemplated by the present invention. Other types of bases include, but are not limited to, bayonet, double contact bayonet, bi-pin, bi-post, wedge, and GU10 turn and lock bases.

In an embodiment of the lighting device 10 according to the present invention, the stabilizer 3 and the electrical base 1 may operate in concert such that rotation of the electrical base 1 into a socket configured to receive the electrical base 1, thereby engaging the electrical base 1 with the socket, may cause the stabilizer 3 to engage one or more elements of the lighting device 10. Similarly, the rotation of the electrical base 1 to disengage the electrical base 1 from the socket may cause the stabilizer 3 to disengage from the elements of the lighting device 10. In the present embodiment of the invention, an interior portion of the electrical base 1 may be threaded so that a bottom portion 15 of the stabilizer 3 may threadably interface and engage with the electrical base 1, thereby connecting the stabilizer 3 to the electrical base 1.

The lighting device 10 may include a body member 2 thermally connected to the stabilizer 3 and also thermally connected to the light source 6 which may include a circuit board 4. The body member 2 may also be connected to an optic 13. The lighting device 10 may also include a spacer 14 positioned between the electrical base 1 and the body member 2. More specifically, the spacer 14 may be a disk spacer. The spacer 14 may be provided to reinforce the structure of the lighting device 10 and keep the body member 2 from directly contacting the electrical base 1. The spacer 14 may be positioned between the electrical base 1 and the body member 2 adjacent to an intermediate portion 16 of the stabilizer 3.

In some embodiments, the body member 2 of the lighting device 10 may be a heat sink that is configured to reduce the operational temperature of the lighting device 10 by facilitating the dissipation of heat into the environment surrounding the lighting device 10. Various elements of the lighting device 10, including the light source 6, may both produce heat and may experience operational degradation when operated at increased temperatures. Accordingly, in some embodiments, the body member 2 may facilitate maintaining the operating temperature of the various elements of the lighting device 10, including the light source 6, within a temperature range by facilitating the dissipation of heat therefrom. In some embodiments the body member 2 may be configured to conduct heat from the heat-generating element of the lighting device 10. In some embodiments, the body member may be configured to dissipate heat by radiation, conduction, or convection into the environment surrounding the lighting device 10. Additional details regarding heat sinks may be found in U.S. patent application Ser. No. 13/107,782 titled Sound Baffling Cooling System for LED Thermal Management and Associated Methods filed May 13, 2011, U.S. patent application Ser. No. 13/461,333 titled Sealed Electrical Device with Cooling System and Associated Methods filed May 1, 2012, U.S. patent application Ser. No. 13/832,900 titled Luminaire with Modular Cooling System and Associated Methods filed Mar. 15, 2013, U.S. patent application Ser. No. 13/739,054 titled Luminaire with Prismatic Optic filed Jan. 11, 2012, and U.S. patent application Ser. No. 14/074,173 titled Luminaire Having Vented Optical Chamber and Associated Methods filed Nov. 7, 2013, the contents of which are incorporated in their entireties by reference, except to the extent disclosures made therein are inconsistent with disclosure made herein.

Additionally, in some embodiments, the body member 2 may be positioned in thermal communication with the stabilizer 3 to enable further cooling capacity by allowing heat from a heat-generating element of the lighting device 10, such as the light source 6, to be channeled from the body member 2 to the stabilizer 3, or vice-versa, wherever there is a greater concentration of heat to be dissipated. As will be described in greater detail hereinbelow, the light source 6 may be enclosed by an optic 13. The optic 13 may also be connected to the body member 2.

The stabilizer 3 of the lighting device 10, described in greater detail above, may be matingly connected to the electrical base 1 and thermally connected to the body member 2. The stabilizer 3 may be moveable from an engaged position with the electrical base 1 to a disengaged position with the electrical base 1. The disengaged position may allow the stabilizer 3 to slidably move in a longitudinal direction with respect to the body member 2. More specifically, when in the disengaged position, the stabilizer 3 may slidably move in a longitudinal direction with respect to the body member 2 so that an engaging member 18 of the stabilizer 3 may be disengaged from the circuit board 4.

The optic 13 may be configured to attach to and be carried by the base member. Additionally, the optic 13 may be configured to define an optical chamber within which the light source 6 may be positioned. Moreover, the light source 6 may be configured to emit light in the direction of the optic 13 such that light may be emitted by the lighting device 10 into the environment surrounding the lighting device 10. Accordingly, the optic 13 may be formed of a transparent or translucent material. In some embodiments, the optic may include an upper section 7 and a lower section 9 configured to interface with each other and, optionally attach to each other. More information regarding the connection between the upper and lower sections 7, 9 will be discussed in greater detail hereinbelow.

In some embodiments, the upper section 7 may include a plurality of vents 8. A skilled artisan would appreciate that the upper section 7 may include a plurality of vents or a singular vent without departing from the scope of the invention. A skilled artisan would also appreciate that the lower section 9 may also comprise, such a feature being contemplated and included within the scope of the invention. A skilled artisan would further appreciate that the plurality of vents may facilitate passive cooling of the light source 6. The use of a vented enclosure is more fully described in a related application Ser. No. 13/875,855 entitled Luminaire Having a Vented Enclosure filed May 2, 2013, which is incorporated by reference herein in its entirety.

In some embodiments, the circuit board 4 may include an aperture 5 formed along a medial portion of the circuit board 4. The aperture 5 may be configured to permit a portion of the stabilizer 3 to pass therethrough. Moreover, the aperture 5 may be configured to permit the engaging member 18 to pass therethrough. Additionally, the portion of the circuit board 4 generally defining the aperture may be configured to facilitate the interfacing of at least one of the engaging member 18 and a crush member 11 therewith, as well as being configured to withstand forces to be exerted thereon by the stabilizer, either directly or indirectly, so as to facilitate the immobilization of the various elements of the lighting device 10 with respect to each other, as discussed herein. The aperture 5 in the present embodiment is circular in shape, but the aperture may be configured to have any polygonal shape. Furthermore, the stabilizer 5 may be configured to generally conform to the shape, such that the stabilizer 5 may pass through the aperture 5 and engage with the circuit board 4.

When in the engaged position, the stabilizer 3 may be slidably fixed with respect to the body member 2 by reducing space between the electrical base 1, the optic 13 and the body member 2. Additionally, when in the engaged position, the engaging member 18 of the stabilizer 3 may engage the circuit board 4, exerting a force thereupon. When in the disengaged position, more space may exist between the electrical base 1, the optic 13 and the body member 2, to the extent that each may be generally spaced apart from and disassociated with the others.

The stabilizer 3 may be configured to conform to the shape of at least one of substantially cylindrical and substantially traverse the length of the lighting device 10. The stabilizer 3 may also be connected to the light source 6 which may further include the circuit board 4.

Figure 3:
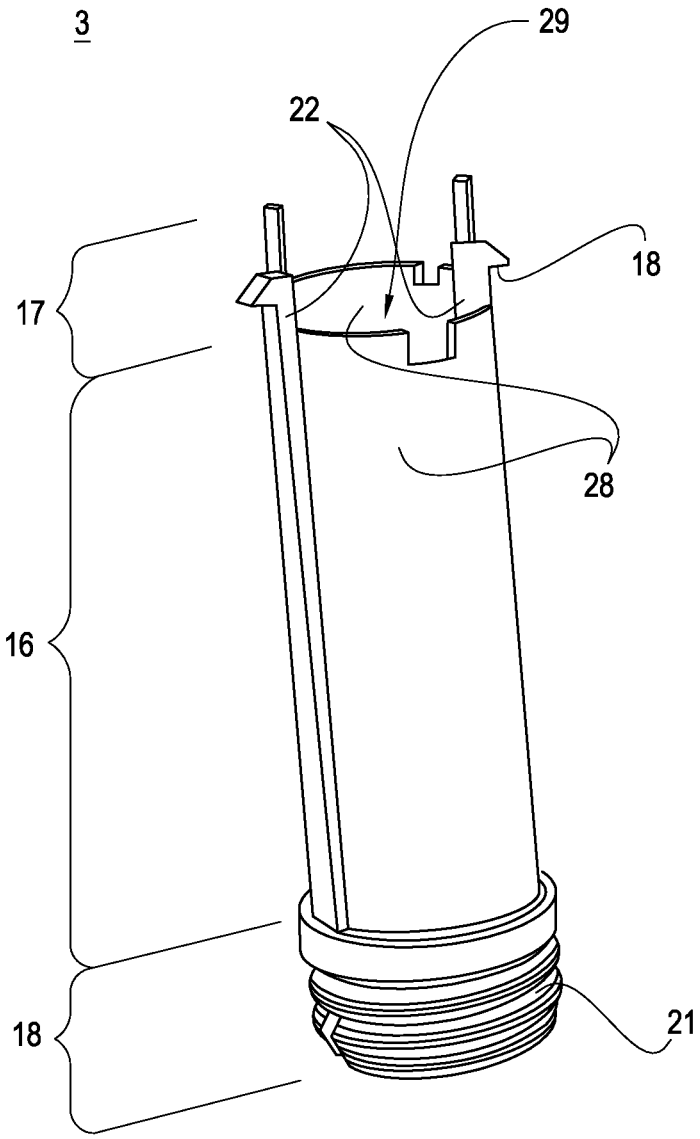
FIG. 3 is a perspective view of a stabilizer of the lighting device illustrated in FIG. 1*a*.

Referring now additionally to FIG. 3, the stabilizer 3 of the lighting device 10 will now be discussed in greater detail. More specifically, portions of the stabilizer, such as, for example, a bottom portion of the stabilizer 15, an intermediate portion of the stabilizer 16 and a top portion of the stabilizer 17, as illustrated in FIGS. 2 and 3 will be discussed in greater detail. The bottom portion 15 of the stabilizer 3 may extend from the bottom of the lighting device 10 to a portion of the stabilizer 3 that is adjacent to the top of the electrical base 1. The intermediate portion 16 of the stabilizer 3 may extend from the top of the electrical base 1 to a portion of the stabilizer that is adjacent to the circuit board 4. The top portion of the stabilizer 3 may extend from a position adjacent to the circuit board 4 to the engaging member 18 of the stabilizer 3. More specifically, the engaging member 18 of the stabilizer 3 may be defined as a hook/tang shaped, or other protruding portion, that extends outwardly from a side portion of the stabilizer so as to provide an edge that may engage and, in some embodiments, interface with, a portion of the circuit board 4. The stabilizer 3 may have a generally cylindrical shape. Accordingly, the intermediate portion 16 of the stabilizer 3 may have a diameter that is less than the diameter of the top portion 17 when measured from the edge of the engaging member 18 of the stabilizer 3. Similarly, the diameter of the bottom portion 15 of the stabilizer 3 may be greater than the diameter of the intermediate portion 16 of the stabilizer.

The bottom portion 15 of the stabilizer 3 may be connected to the electrical base 1. More specifically, the bottom portion 15 of the stabilizer may have a threaded bottom. Similarly, the interior portion of the electrical base 1 may also be threaded. Accordingly, the bottom portion 15 of the stabilizer 3 may threadably engage the interior portion of the electrical base 1. The intermediate portion 16 of the stabilizer 3 is illustratively interfaced with the body member 2. The lower section 9 and extends through a medial portion of the lighting device 10. The top portion 17 of the stabilizer 3 may extend through an aperture 5 in the circuit board 4 and terminate in an engaging member 18 that is configured to engage the circuit board 4.

Additional details regarding the stabilizer 3 will now be discussed. The stabilizer may comprise a base member 21 located in the bottom portion 15 of the stabilizer 3. The stabilizer 3 may further include a plurality of arms 22 extending generally upward from the base member 21. Each arm of the plurality of arms 22 may include an engaging member positioned at an upper end, the upper end generally defining and being coextensive with the top portion 17 of the stabilizer 3. The base member 21 may be configured to have a perimeter defining a shape, including a circle, as in the present embodiment. It is contemplated and included within the scope of the invention that the base member 21 may be configured to have any shape, including any polygon.

The plurality of arms 22 may be distributed generally uniformly and/or evenly about the perimeter of the base member 21 or they may distributed non-uniformly and/or unevenly. Furthermore, the plurality of arms 22 may include any number of arms. In the present embodiment, the plurality of arms 22 includes 2 arms. Any other number of arms is contemplated and included within the scope of the invention. The engaging member 18 of each arm of the plurality of arms may be configured to form a ledge 24 that extends horizontally from the arm of the plurality of arms 22. The engaging member 18 may be adapted to pass through the aperture 5 of the circuit board 4.

Moreover, the engaging member 18 may be configured to facilitate the translation of the arms of the plurality of arms 22 through the aperture 5. In some embodiments, the engaging member 18 may include a sloped surface 23 that is configured to interface with the edge of the circuit board 4 that defines the aperture 5. As the stabilizer 3 translates longitudinally in the generally upward direction, the interface between the sloped surface 23 and the circuit board 4 may cause the plurality of arms 22 to deflect generally inward. Once the stabilizer 3 has been translated longitudinally a sufficient distance generally upwards, the sloped surface 23 may translate beyond the circuit board 4, and the force exerted by the circuit board 4 thereupon will be released, resulting in the plurality of arms 22 returning to their undeflected state. When the stabilizer 3 is subsequently translated generally downwards, the ledge 24 may engage the circuit board 4, either directly by interfacing with the circuit board 4 or indirectly by interfacing with another element of the lighting device 10, and may prevent further downward translation of the stabilizer 3 relative to the circuit board, and furthermore may exert a force on the circuit board as described herein.

Additionally, in some embodiments, the stabilizer 3 may include one or more wall members 28. The one or more wall members 28 may be positioned generally within the intermediate portion 16. The one or more walls 28 may cooperate with one another, as well as the plurality of arms 22, to define a circuitry chamber 29 configured to permit the positioning therewithin of at least one of power circuitry and control circuitry, or both, as will be discussed in greater detail hereinbelow.

In some embodiments, as illustrated in FIG. 1, the stabilizer 3 may interface directly with the circuit board 4. In such embodiments, the circuit board 4 may be configured to interface with each of the body member 2 and a ridge member 20 of the optic 13. The ridge member 20 may be a structure protruding generally inward from a lower end of the upper section 7 of the optic 13 and may be configured to facilitate the interfacing of the circuit board 4 therewith. The clamping force exerted by the stabilizer 3 on the circuit board 4 as described hereinabove may, in turn, exert a downward force on the ridge member 20, thereby pressing the upper section 7 of the optic 13 into the lower section 9 of the optic 13. Similar to the circuit board 4, the lower section 9 may experience a clamping force as a result of the force exerted by the upper section 7 and resistance from the body member 2. Accordingly, each of the upper and lower sections 7, 9 may be prevented from moving relative to each other, as well as the body member 2, as a result of the force exerted on the circuit board 4 by the stabilizer 3 when the stabilizer is in the engaged position.

Additionally, in some embodiments, as illustrated in FIG. 2, the lighting device 10 may further include a crush member 11. The crush member 11 may be affixed or positioned adjacent to the circuit board 4 of the light source 6. The crush member 11 may be configured to secure the circuit board 4 to the optic 13.

Additionally, the upper section 9 of the optic 13 may include a connecting member 25. The connecting member may be configured to interface with at least one of the stabilizer 3, the crush member 11, or both. More specifically, a first surface 25 of the connecting member 25 may be configured to interface with the crush member 11, and a second surface 26 of the connecting member may be configured to interface with the stabilizer 3. Further, the second surface 26 may be configured to interface with the ledge 24 of an engaging member 18 of an arm of the plurality of arms 22.

Through the interface between the second surface 26 and the ledge 24, the stabilizer may exert a downward force on the connecting member 25, which may in turn exert a downward force on the lower section 9, thereby exerting a clamping force on the lower section 9 and inhibiting the movement of each of the upper and lower sections 7, 9 relative to the stabilizer 3. Moreover, the downward force of the stabilizer 3 on the connecting member 25 may result in the exertion of a downward force on the circuit board 4 transmitted through the crush member 11. The crush member 11 may be configured to transmit the downward force to the circuit board 4 while preventing or generally reducing the possibility of damaging the circuit board 4 as a result of the exertion of the downward force thereon. Accordingly, the circuit board 4 may be inhibited from moving relative to the stabilizer 3.

In some embodiments, the connecting member 25 may be in a generally continuous and circular configuration. The connecting member 25 may have an arm-type configuration similar to that of the plurality of arms 22 of the stabilizer 3. Moreover, the upper section 7 may include a number of connecting members 25 that equals the number of arms of the plurality of arms 22, such that each connecting member 25 is associated with and configured to engage with an arm of the plurality of arms 22.

Additionally, the connecting member 25 may include a sloped surface 27. The sloped surface 27 may be configured to cooperate with the sloped surface 23 of the stabilizer 3 so as to deflect the plurality of arms 22 generally inward such that the engaging members may translate longitudinally past the connecting members.

It is contemplated and included within the scope of the invention that in the embodiments described hereinabove, wherever a force is described as being exerted, the relevant elements of the lighting device may be positioned generally adjacent to each other such that no force is exerted upon the other, but that the distance between those elements is either negligible or zero. Accordingly, movement relative to one another is thereby constrained.

Figure 4:
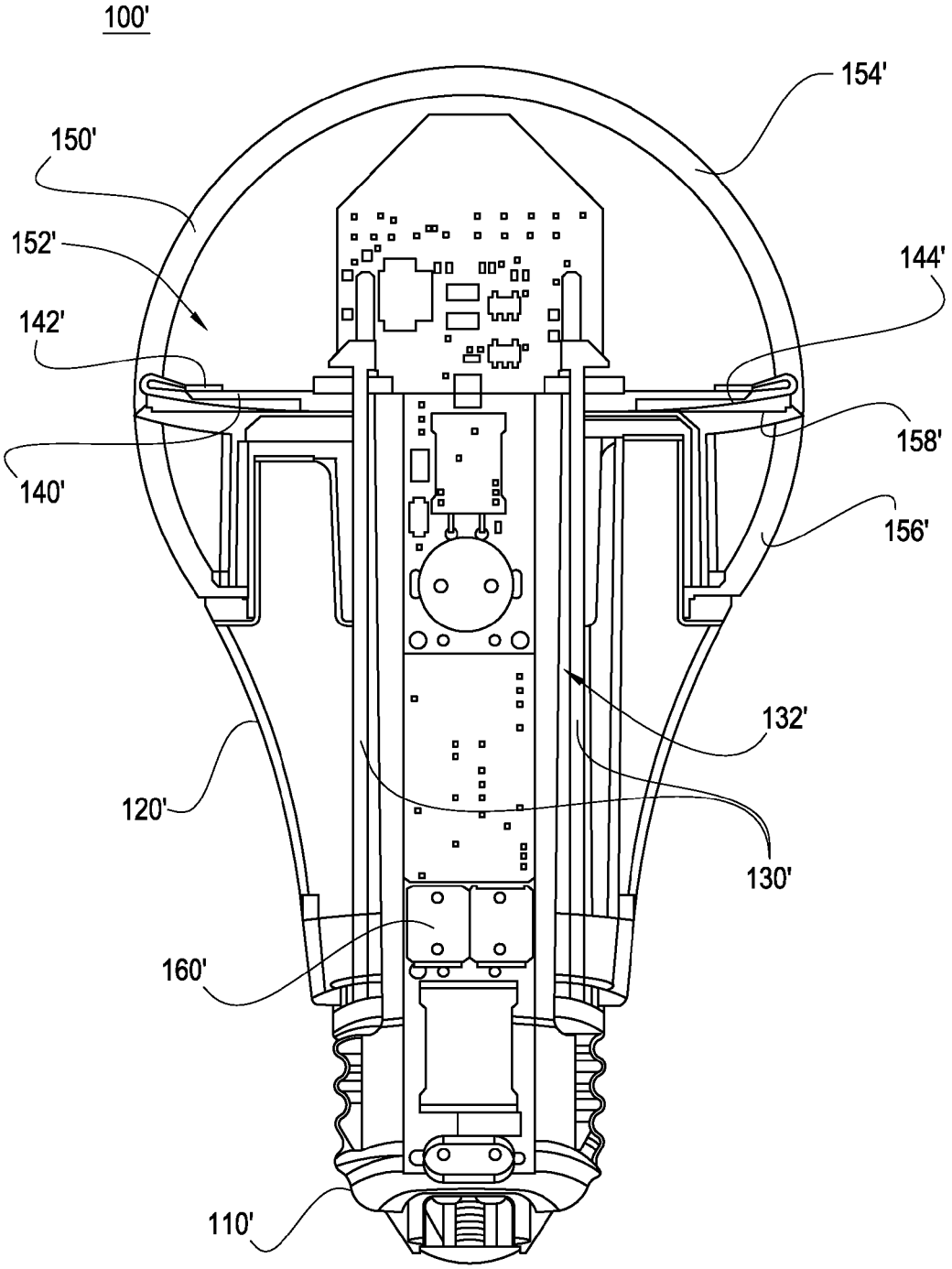
FIG. 4 is a side sectional view of a lighting device according to an embodiment of the invention.

Referring now to FIG. 4, an additional embodiment of the present invention is presented. In the present embodiment, a lighting device 100' may include many of the elements as described in the embodiments depicted in FIGS. 1*a*-3, including an electrical base 110', a body member 120', a stabilizer 130', a light source 140', and an optic 150'. As described hereinabove, the body member 120' may be positioned in thermal communication with at least one of the stabilizer 130' and the light source 140, and may additionally be configured as a heat sink. The relative positioning and functionality of the various elements of the lighting device 100' may be the same as described hereinabove except as may be inconsistent with the description provided hereinbelow.

Furthermore, the stabilizer 130' may define a circuit chamber 132' as described hereinabove, and the optic 150' may define an optical chamber 152'. The lighting device 100' may further include control circuitry 160' positioned at least partially within the circuit chamber 132' and at least partially within the optical chamber 152'. In some embodiments, the control circuitry 160' may be positioned entirely within the circuit chamber 132'. The control circuitry 160' may be positioned in electrical communication with the electrical base 110' as well as the light source 140'.

The control circuitry 160' may be configured to receive electrical power from a power source via the electrical base 110'. Moreover, the control circuitry may be configured to condition the electrical power received via the electrical base for use by the various electrical components of the lighting device 100', including, but not limited to, the light source 140'. Further, the control circuitry 160' may be configured to control the operation of the light source 140'. Where, as in the present embodiment, the light source 140' comprises a plurality of LEDs 142', the control circuitry 160' may be configured to control the operation of each of the plurality of LEDs 142', either individually or in combination. Accordingly, the control circuitry 160' may include the electrical components and connections therebetween in order to enable the function described hereinabove.

Furthermore, it is contemplated and included within the scope of the invention that the control circuitry 160' may be included in the embodiments depicted in FIGS. 1*a*-3 and as described hereinabove in order to enable and control the operation of the lighting device as described. The control circuitry may be carried by at least one of the stabilizer 130' and the body member 120'.

As similarly described above, the optic 150' may include an upper section 154' and a lower section 156'. In the present embodiment, the lower section 156' may include a shelf 158'. The shelf 158' may be configured to interface with the light source 140'. More specifically, the shelf 158' may be configured to interface with a circuit board 144' of the light source 140'. The interface between the shelf 158' and the circuit board 144' may, when the stabilizer 130' is in an engaged position as described hereinabove, prevent relative motion between the circuit board 144' and the lower section 156' of the optic 150'. Additionally, the interface between the shelf 158' and the circuit board 144' may prevent relative motion between the light source 140', the optic 150', including the upper and lower sections 154', 156', the body member 120', and the electrical base 110'.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A lighting device comprising:

an electrical base;

a stabilizer adapted to be matingly connected to the electrical base;

a body member engaged with the stabilizer;

an optic connected to the body member and defining an optical chamber; and a light source positioned adjacent to the body member, within the optical chamber, and positioned in electrical communication with the electrical base;

wherein the stabilizer is moveable from an engaged position with the electrical base and a disengaged position with the electrical base;

wherein the disengaged position allows for the stabilizer to translate longitudinally with respect to the body member; and wherein the engaged position prevents the stabilizer from translating longitudinally with respect to the body member.

2. The lighting device of claim 1 wherein the stabilizer is substantially cylindrical.

3. The lighting device of claim 1 wherein the stabilizer includes a bottom portion configured to matingly engage the electrical base, an intermediate portion, and a top portion.

4. The lighting device of claim 3 wherein a spacer is positioned between the electrical base and the body member adjacent to the intermediate portion of the stabilizer.

5. The lighting device of claim 3 wherein the light source comprises a circuit board and a plurality of light sources mounted thereto, the circuit board having an aperture formed therein along a medial portion thereof; wherein the bottom portion of the stabilizer is threaded; wherein an interior portion of the electrical base is configured to threadably connect to the bottom portion of the stabilizer; wherein the top portion of the stabilizer comprises an engaging member adapted to pass through the aperture of the circuit board; wherein rotation of the electrical base in a first direction causes the stabilizer to be positioned in the engaged position so that the engaging member of the stabilizer engages the circuit board; and wherein rotation of the electrical base in a second direction causes the stabilizer to be positioned in the disengaged position so that the engaging member of the stabilizer disengages the circuit board.

6. The lighting device of claim 5 wherein the plurality of light sources comprise light emitting diodes (LEDs) that are positioned circumferentially on the circuit board.

7. The lighting device of claim 5 wherein the stabilizer is configured to exert a force on the circuit board when in the engaged position.

8. The lighting device of claim 1 wherein the optic comprises an upper section and a lower section.

9. The lighting device of claim 8 wherein the upper section of the optic includes a plurality of vents.

10. The lighting device of claim 8 wherein the upper section is configured to interface with each of the circuit board and the lower section; wherein the circuit board is configured to exert a generally downward force upon the upper section when the stabilizer is in the engaged position, and wherein the upper section is configured to exert a generally downward force on the lower section when the stabilizer is in the engaged portion.

11. The lighting device of claim 10 wherein the upper section comprises a ridge; and wherein the ridge is configured to interface with the circuit board.

12. The lighting device of claim 8 wherein the upper section is configured to interface with the lower section; wherein the upper section comprises a connecting member configured to interface with the stabilizer; wherein the stabilizer is configured to exert a generally downward force upon the connecting member when the stabilizer is in the engaged position; and wherein the upper section is configured to exert a generally downward force on the lower section when the stabilizer is in the engaged position.

13. The lighting device of claim 12 further comprising a crush member; wherein the crush member is positioned between and configured to interface with each of the connecting member and the light source.

14. The lighting device of claim 1 wherein the body member is a heat sink; and wherein the body member is positioned in thermal communication with at least one of the light source and the stabilizer.

15. A lighting device comprising:

an electrical base having a threaded interior portion;

a stabilizer having a threaded bottom portion that threadably connects to the electrical base, and an engaging member on a top portion;

a body member;

an optic connected to the body member and defining an optical chamber;

a light source positioned within the optical chamber and in electrical communication with the electrical base, the light source comprising a circuit board and a plurality of LEDs circumferentially mounted thereto, the circuit board having an aperture formed therein along a medial portion thereof; and a spacer positioned between the electrical base and the body member adjacent to an intermediate portion of the stabilizer;

wherein the engaging member of the stabilizer is adapted to pass through the aperture of the circuit board;

wherein rotation of the electrical base in a first direction causes the stabilizer to be positioned in an engaged position defined as the stabilizer being prevented from translating longitudinally relative to the body member and the engaging member of the stabilizer engaging the circuit board; and wherein rotation of the electrical base in a second direction causes the stabilizer to be positioned in a disengaged position defined as the stabilizer being translatable longitudinally relative to the body member such that the engaging member of the stabilizer disengages the circuit board.

16. The lighting device of claim 15 wherein the stabilizer is substantially cylindrical.

17. The lighting device of claim 15 wherein the optic comprises a top section and a bottom section.

18. A lighting device comprising:

an electrical base;

a stabilizer threadably connected to the electrical base;

a body member positioned in thermal communication with the stabilizer;

an optic connected to the body member and defining an optical chamber; and a light source positioned within the optical chamber, in thermal communication with the body member, and in electrical communication with the electrical base;

a spacer positioned between the electrical base and the body member adjacent to an intermediate portion of the stabilizer;

wherein the stabilizer is transitionable between an engaged position and a disengaged position;

wherein the disengaged position is defined as the stabilizer being translatable longitudinally with respect to the body member; and wherein the engaged position is defined as the stabilizer being moveably fixed with respect to the body member.

19. The lighting device of claim 18 wherein the light source comprises a circuit board and a plurality of LEDs that are circumferentially positioned on the circuit board.

20. The lighting device of claim 19 wherein the circuit board comprises an aperture formed therein along a medial portion thereof; wherein a top portion of the stabilizer comprises an engaging member and configured to be positioned through the aperture of the circuit board; wherein the stabilizer is configured to be transitioned to the engaged position, thereby engaging the circuit board, upon rotation of the electrical base in a first direction; and wherein the stabilizer is configured to be transitioned to the disengaged position, thereby disengaging the circuit board, upon rotation of the electrical base in a second direction.

21. The lighting device of claim 18 wherein the optic comprises a top section and a bottom section.

22. The lighting device of claim 21 wherein the top section of the optic includes a plurality of vents.

* * * * *